US010984761B2

(12) United States Patent
Ogawa et al.

(10) Patent No.: US 10,984,761 B2
(45) Date of Patent: Apr. 20, 2021

(54) KEY ASSEMBLY AND KEYBOARD APPARATUS

(71) Applicant: YAMAHA CORPORATION, Hamamatsu (JP)

(72) Inventors: Kento Ogawa, Funabashi (JP); Ichiro Osuga, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/018,352

(22) Filed: Sep. 11, 2020

(65) Prior Publication Data

US 2020/0410964 A1 Dec. 31, 2020

Related U.S. Application Data

(63) Continuation of application No. PCT/JP2018/012051, filed on Mar. 26, 2018.

(51) Int. Cl.

| | |
|---|---|
| ***G10C 3/161*** | (2019.01) |
| ***G10C 3/12*** | (2006.01) |
| ***G10H 1/34*** | (2006.01) |

(52) U.S. Cl.

CPC ..... *G10C 3/161* (2013.01); *G10C 3/125* (2013.01); *G10H 1/344* (2013.01)

(58) Field of Classification Search

CPC ..... G10C 3/161; G10C 3/125; G10C 3/16; G10C 3/12; G10H 1/344

See application file for complete search history.

(56) References Cited

U.S. PATENT DOCUMENTS

2013/0180390 A1* 7/2013 Ishida ..... G10H 1/34 84/745

FOREIGN PATENT DOCUMENTS

| | | | |
|---|---|---|---|
| JP | S492178 | Y1 | 1/1974 |
| JP | S5144915 | U | 4/1976 |
| JP | S5340220 | U | 4/1978 |
| JP | S6113897 | U | 1/1986 |
| JP | H08194468 | A | 7/1996 |
| JP | 2008090167 | A | 4/2008 |

OTHER PUBLICATIONS

International Search Report issued in Intl. Appln No. PCT/JP2018/012051 dated Jun. 5, 2018. English translation provided.

Written Opinion issued in Intl. Appln. No. PCT/JP2018/012051 dated Jun. 5, 2018.

* cited by examiner

*Primary Examiner* — Kimberly R Lockett

(74) *Attorney, Agent, or Firm* — ROSSI, KIMMS & McDOWELL LLP

(57) ABSTRACT

A key assembly includes a capstan and a key. The key includes an upper surface, a hole part having a first inner side surface supporting the capstan, and an opening part arranged between the upper surface and the hole part, the opening part having a second inner side surface surrounding the capstan.

20 Claims, 22 Drawing Sheets

KEY ASSEMBLY AND KEYBOARD APPARATUS

CROSS REFERENCES TO RELATED APPLICATIONS

This application is based upon and claims the benefit of priority from the prior International Application PCT/JP2018/012051, filed on Mar. 26, 2018, the entire contents of which are incorporated herein by reference.

FIELD

The present disclosure relates to a key used in a keyboard apparatus.

BACKGROUND

Keyboard instruments are composed of many components, and an action mechanism arranged for each key is very complicated. In the keyboard instrument, the key pressing operation consists of the steps of rotating the key, moving the hammer through the action mechanism, and sounding by striking the string with the hammer. At this time, the key is rotated by the key pressing operation, and the action mechanism is driven by the capstan attached to the rear part of the key. The capstan is screw-type and the height of the capstan screw can be adjusted by turning the capstan screw. By adjusting the height of the capstan screw, the height of the hammer (the striking distance of the string) through the action mechanism can be adjusted.

The operation of the key, the action mechanism, and the hammer provides a sense of touch (hereinafter referred to as a touch feeling) to the player's fingers through the key. Therefore, the touch feeling of the key can be changed by adjusting the striking distance of the string by the capstan screw. Further, by adjusting the striking distance of the string of each keys of the keyboard instrument, the touch feeling of each key can be adjusted. The key, the action mechanism, and the hammer are mainly composed of woods, and the adjustments may be deviated due to environmental changes, aging changes, and the like. Even in such cases, the same touch feeling can be maintained at any time by adjusting the striking distance of the string by the capstan screw.

Japanese laid-open patent publication No. 2008-90167 discloses that a key of a keyboard instrument in which the mounting position of the capstan on the key body can be adjusted to any position of front-rear direction, thereby, the touch weight of the key can be adjusted in a wider range.

SUMMARY

A key assembly according to one embodiment of the present disclosure includes a capstan, and a key including an upper surface, a hole part having a first inner side surface supporting the capstan, and an opening part arranged between the upper surface and the hole part, the opening part having a second inner side surface surrounding the capstan.

A key apparatus according to one embodiment of the present disclosure includes a key bed, a key assembly including a capstan and a key, the key assembly rotatably arranged with respect to the key bed, and an action mechanism mounted on the capstan. The key including an upper surface, a hole part having an inner side surface for supporting the capstan, and an opening part arranged between the upper surface and the hole part, the opening part having an inner side surface surrounding the capstan.

DESCRIPTION OF EMBODIMENTS

Figure 1:
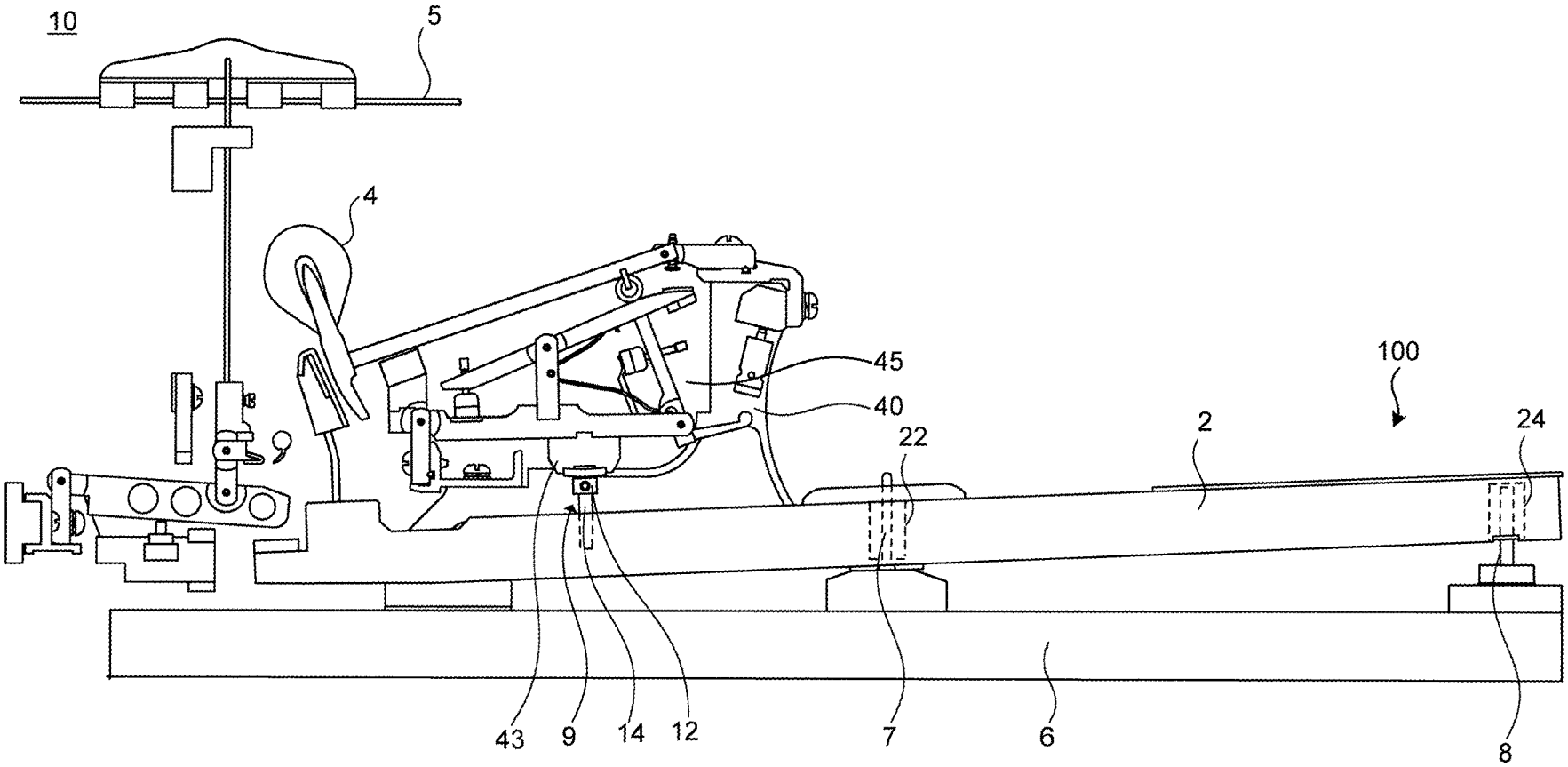
FIG. 1 is an enlarged view showing the vicinity of an action mechanism of a keyboard apparatus in one embodiment of the present disclosure.

Hereinafter, a keyboard apparatus according to embodiments of the present disclosure will be described in detail by referring to the drawings. The following embodiments are examples of the embodiments of the present disclosure, and the present disclosure is not construed as being limited to these embodiments. In the drawings referred to in the present embodiments, the same portions or portions having similar functions are denoted by the same reference numerals or similar reference numerals (only A, B, etc. are denoted after numerals), and repetitive description thereof may be omitted. The dimensional ratios of the drawings (the ratio between the respective components and the ratio in the vertical and horizontal height directions, etc.), may be different from the actual ratios for convenience of description, or a part of the configurations may be omitted from the drawings.

The directions (the rotation direction R and the yawing direction Y) used in the following description will be defined. The rotation direction R corresponds to the rotation direction of the key 2. The yawing direction Y is a direction in which the key 2 bends in the left-right direction when viewed from above. The movement of key 2 in the yawing direction Y corresponds to bending (warping) in the scale direction S.

In Japanese laid-open patent publication No. 2008-90167, no consideration is given to suppress the deviation of the adjustment due to an environmental change and an aging change, etc. One of the objects of the present disclosure is to suppress the deviation of the adjustment and improve the reliability by suppressing an environmental change and an aging change of the key.

First Embodiment

[General Configuration of a Keyboard Apparatus]

In this embodiment, as an example of a keyboard apparatus, a grand piano having a keyboard on the front of which a plurality of keys to be performed by a player is arranged, will be described. However, the keyboard apparatus is not limited to this, and may be any keyboard apparatus driven by a key assembly having a key and a capstan screw, to be described later.

The plurality of keys includes white keys and black keys. The plurality of white keys and The plurality of black keys are arranged side by side. The number of keys is N, which we assumed to be 88. The direction in which a plurality of keys is arranged is referred to as a scale direction. Here, the white keys and the black keys will be referred to as key 2 in the case of being described without making a distinction.

[Configuration of a Keyboard Assembly]

FIG. 1 is an enlarged view showing the vicinity of an action mechanism of a keyboard apparatus. In FIG. 1, the configuration arranged corresponding to each key 2 is shown with reference to the configuration arranged for one key 2 shown (in this example, the white key), and the configuration arranged for the other key 2 is omitted from the description.

In the descriptions of the present specification, the directions such as upward, downward, leftward, rightward, frontward, and rearward indicate the directions when the keyboard apparatus is viewed by the player during performance. In some cases, the directions may be indicated with respect to the key 2 as a reference, such as a front end side of the key (key front side) and a rear end side of the key (key rear side). In this case, the front end side of the key indicates the frontward of the key 2 as seen from the player. The rear end side of the key indicates the rearward of the key 2 as seen from the player.

As shown in FIG. 1, a keyboard assembly 10 is arranged in the keyboard apparatus. The keyboard assembly 10 includes a key assembly 100 including key 2, an action mechanism 45, a hammer 4, and a key bed 6. The keyboard assembly 10 is mostly a wooden construction. The key bed 6 is fixed at the housing of the keyboard apparatus. The key bed 6 has a balance pin 7. The balance pin 7 of the key bed 6 rotatably connects the key assembly 100 to the key bed 6. The balance pin 7 provides a fulcrum for supporting the key assembly 100 almost at the center of the direction in which the key 2 extends. Therefore, the key assembly 100 rotates around the balance pin 7 as a fulcrum with respect to the key bed 6 by the key pressing operation of the key 2.

The key assembly 100 has a capstan screw 9 at the rear end side of the fulcrum (the position supported by the balance pin 7) of the key 2. The capstan screw 9 is a metallic construction. The capstan screw 9 includes a head part 12 and a shaft part 14. The shaft part 14 of the capstan screw 9 is fastened to the top side of the key 2, and the head part 12 of the capstan screw 9 is arranged above the key 2. In other words, the head part 12 of the capstan screw 9 protrudes above the key 2. The configuration of the fastening points of the capstan screw 9 and the key 2 will be described in detail later.

On the top of the key assembly 100, the action mechanism 45 and the hammer 4 are arranged rotatably with respect to the frame 40. The action mechanism 45 and the hammer 4 are arranged corresponding to the key assembly 100. The support heel 43 arranged on the lower surface of the action mechanism 45 is slidably in contacts with the upper surface of the capstan screw 9 of the key assembly 100. This sliding part, i.e. the part where the support heel 43 of the action mechanism 45 and the capstan screw 9 of the key assembly 100 contact, is arranged backward from the fulcrum (the position supported by the balance pin 7) of the key 2 and above the key 2.

In the normal state (when the key is not pressed), the action mechanism 45 is placed above the capstan screw 9 of the key assembly 100, and the front end of the key 2 is pushed up. When the front end of the key 2 is depressed, the key assembly 100 rotates around the fulcrum, and the capstan screw 9 moves the hammer 4 upward through the action mechanism 45. As a result, the hammer 4 hits the string 5 arranged corresponding to the key assembly 100. The string 5 has a vibrational frequency corresponding to each key assembly 100 and emits sound by the impact of the hammer 4. When the key 2 is released, the key assembly 100 rotates around the fulcrum and returns to its original position, and moves the action mechanism 45 and the hammer 4 downwardly. The capstan screw 9 is defined as the position at which the action mechanism 45 is driven and the key 2 is loaded.

[Configuration of a Fastening Point of a Capstan Screw and a Key]

A configuration of a fastening point of a capstan screw and a key will be described in detail with reference to FIGS.

Figure 2:
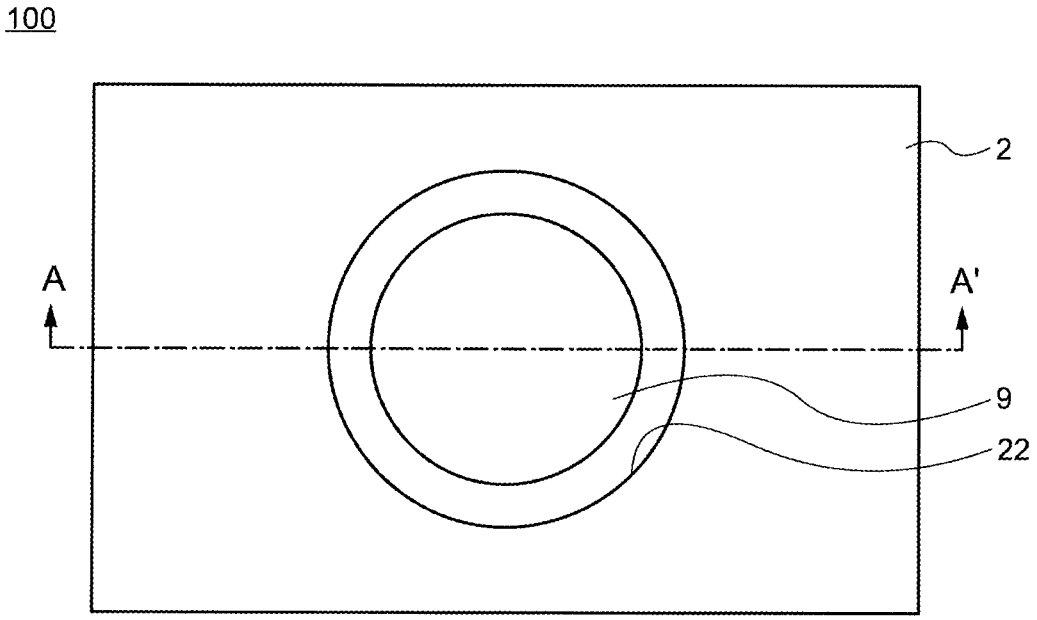
FIG. 2 is a partial enlargement top view showing a fastening point of a capstan screw and a key in one embodiment of the present disclosure.
Figure 3:
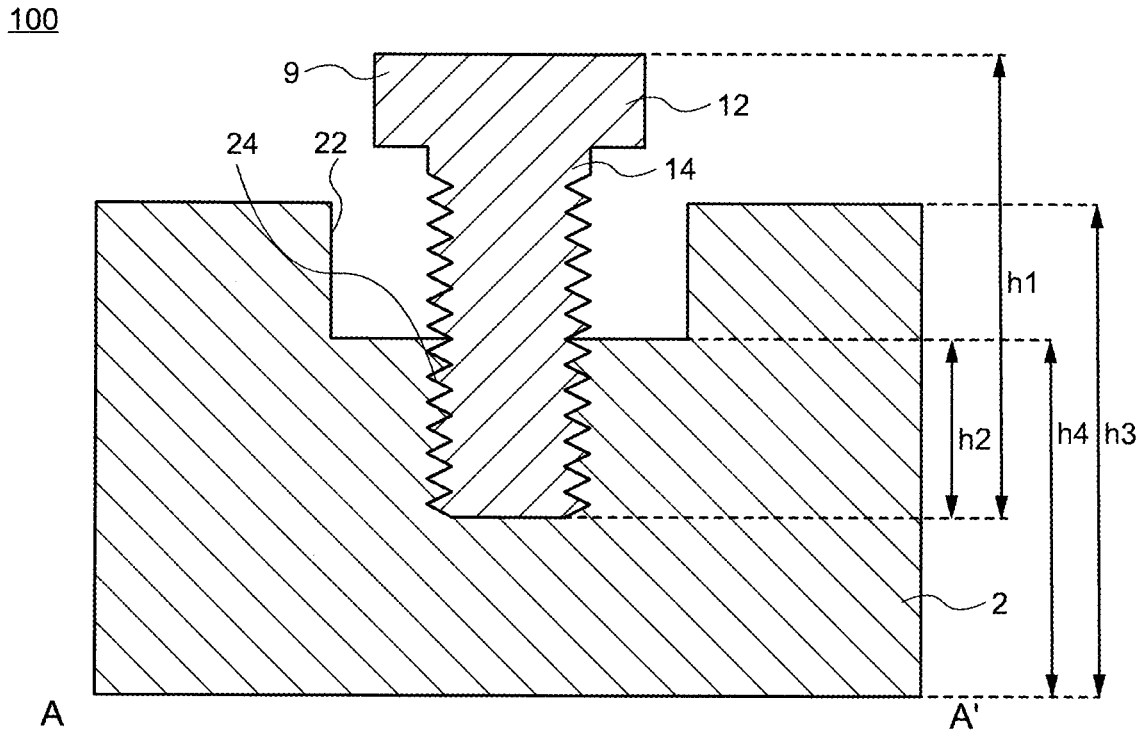
FIG. 3 is a partial enlargement cross-sectional view showing a fastening point of a capstan screw and a key in one embodiment of the present disclosure.
Figure 4:
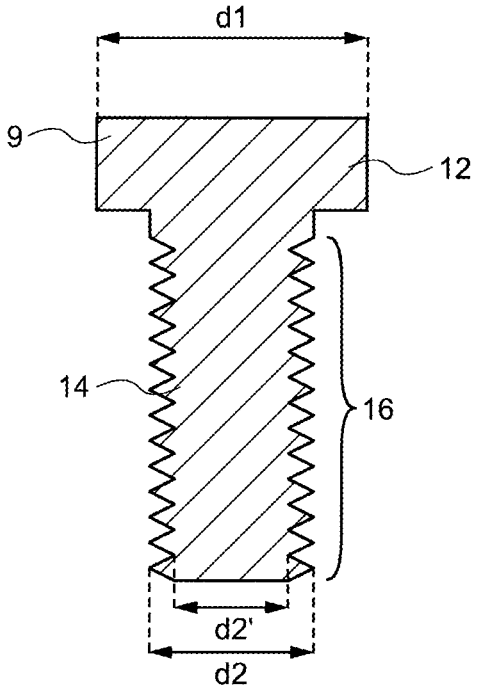
FIG. 4 is a partial enlargement cross-sectional view showing the capstan screw prior to fastening in one embodiment of the present disclosure.
Figure 5:
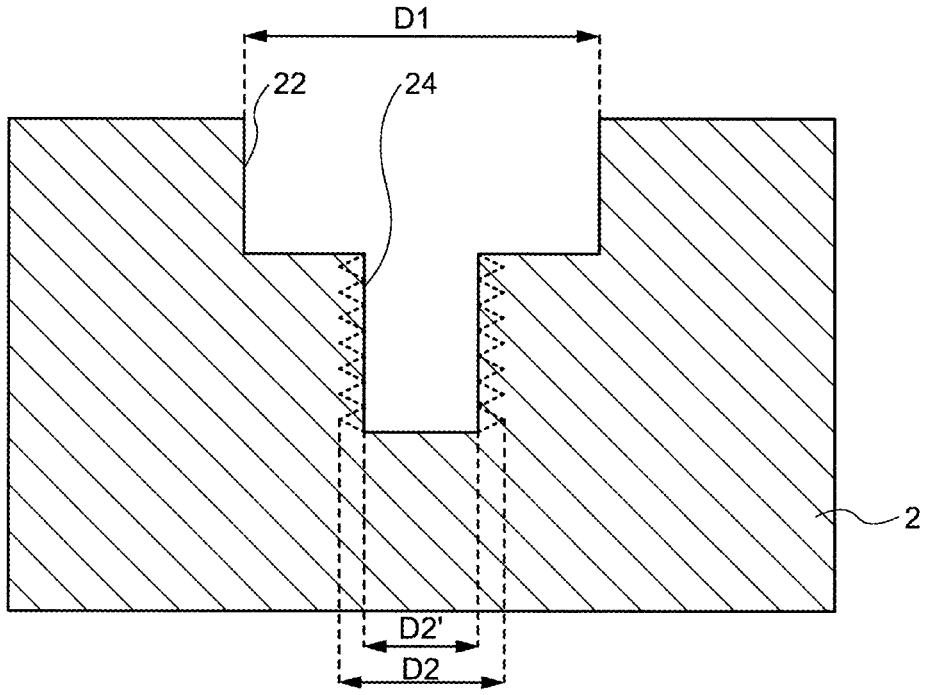
FIG. 5 is a partial enlargement cross-sectional view showing the key prior to fastening in one embodiment of the present disclosure.

2 to 5. FIG. 2 is a partial enlarged top view of a fastening point of a capstan screw and a key according to an embodiment of the present disclosure. FIG. 3 is a partial enlarged cross-sectional view of the fastening point of the capstan screw and the key according to an embodiment of the present disclosure. FIG. 4 is a partial enlargement cross-sectional view of the capstan screw prior to fastening in one embodiment. FIG. 5 is a partial enlargement cross-sectional view of the key prior to fastening in one embodiment.

The capstan screw 9 includes a head part 12 and a shaft part 14. In this embodiment, the shaft part 14 has a screw part 16. The screw part 16 of the capstan screw 9 is fastened to the hole part 24 of the key 2. The diameter d1 of the head part 12 is larger than the diameter d2 of the screw part 16. Here, the diameter d1 of the head part 12 indicates the maximum diameter of the head part 12 as seen in the axial direction, the diameter d2 of the screw part 16 indicates the maximum diameter of the screw part 16 as seen in the axial direction. Since the diameter d1 of the head part 12 of the capstan screw 9 is larger than the diameter d2 of the screw part 16, the action mechanism 45 can be mounted stably on the capstan screw 9, and the action mechanism 45 can be slid stably on the capstan screw 9 in accordance with the pressing and releasing operation of the key. In this embodiment, the head part 12 and the shaft part 14 as seen from the top surface are circular. The center of the head part 12 is almost coincident with the center of the shaft part 14 as seen from the top surface. However, the present disclosure is not limited thereto, and the head part 12 may be a polygonal, for example, and the center of the head part 12 and the center of the shaft part 14 may misaligned each other.

The key 2 includes an opening part 22 and a hole part 24 having an inner side surface for supporting the capstan screw 9 on the upper surface (the surface to be pressed). Here, the hole part 24 is arranged at the bottom of the opening part 22. That is, the opening part 22 is arranged at a upper surface side of the key 2 than the hole part 24. The opening part 22 and the hole part 24 are continuous in the direction of rotation of the key assembly 100. Since the hole part 24 for supporting the capstan screw 9 is arranged at the bottom of the opening part 22, the width of the key 2 around the region on which the capstan screw 9 is supported in the direction of rotation of the key 2 that is subject to the environmental changes and the aging changes is reduced from h3 to h4. Therefore, if the amount of change in the rotation direction of the key 2 is the same rate, the amount of change in the axial direction that the capstan screw 9 receives from the key 2 is suppressed to h4/h3. By arranging the hole part 24 on which the capstan screw 9 is supported at the bottom of the opening part 22, the effect of the capstan screw 9 subjected in the rotational directions of the key 2 due to the environmental changes and aging changes can be suppressed. Therefore, the key assembly 100 can suppress the deviation of the adjustment.

The inner side surface of the opening part 22 and the inner side surface of the hole part 24 are both arranged so as to surround the capstan screw 9. In other words, the opening part 22 and the hole part 24 are bores that are closed other than the rotatable orientation of the key assembly 100. Therefore, the width of the opening part 22 in the scale direction is smaller than the width of the key 2 in the scale direction. Since the opening part 22 is arranged so as to surround the capstan screw 9, a large part of the key 2 can maintain the width h3 in the rotational direction. Therefore, the key 2 can maintain sufficient strength even if the key 2 has the opening part 22, and the key assembly 100 can maintain the reliability.

In this embodiment, the opening part 22 and the hole part 24 as seen from the top surface are circular. The center of the opening part 22 is almost coincident with the center of the hole part 24 as seen from the top surface. However, the present disclosure is not limited thereto, and the opening part 22 may be a polygonal, for example, and the center of the opening part 22 and the center of the hole part 24 may misaligned each other. In this embodiment, the diameter D1 of the opening part 22 is larger than the diameter D2 of the hole part 24. Here, the diameter D1 of the opening part 22 indicate the maximum diameter of the opening part 22 as seen from the top surface, the diameter D2 of the hole part 24 indicate the maximum diameter of the hole part 24 as seen from the top surface.

In this embodiment, the screw part 16 of the capstan screw 9 is spaced from the inner side surface of the opening part 22. The diameter D1 of the opening part 22 is larger than the maximum diameter d2 of the screw part 16.

The head part 12 of the capstan screw 9 is arranged outside the opening part 22. That is, the head part 12 of the capstan screw 9 protrudes to the upper surface side of the key 2. In this embodiment, the diameter d1 of the head part 12 of the capstan screw 9 is smaller than the diameter D1 of the opening part 22. However, the diameter of the head part 12 of the capstan screw 9 may be larger than the diameter of the opening part 22.

The screw part 16 of the capstan screw 9 engages the inner side surface of the hole part 24. Thus, the maximum diameter d2 of the screw part 16 (the diameter between the peaks cutting edge of a male screw) and the maximum diameter D2 of the hole part 24 (the diameter between the valleys cutting edge of a female screw) are almost same. The minimum diameter d2' of the screw part 16 (the diameter between the valleys cutting edge of a male screw) and the minimum diameter D2' of the hole part 24 (the diameter between the peaks cutting edge of a female screw) are almost the same. As shown in FIG. 5, the hole part 24 prior to fastening the capstan screw 9 is a prepared hole which has not been internally threaded. Therefore, the maximum diameter of the hole part 24 prior to fastening the capstan screw 9 is almost the same as the minimum diameter d2' of the screw part 16. As shown by the dotted line in FIG. 5, the hole part 24 is internally threaded by fastening the capstan screw 9, and the maximum diameter D2 of the hole part 24 is almost the same as the maximum diameter d2 of the screw part 16. However, the present disclosure is not limited thereto, and if the tip portion of the capstan screw 9 is sharp, the diameter of the prepared hole may be smaller than the minimum diameter d2' of the screw part 16, or the prepared hole may not be provided. In the present embodiment, the screw part 16 and the hole part 24 as seen from the top surface is circular. The outer surface of the screw part 16 engages with the inner side surface of the hole part 24 in almost the entire circumferential direction. However, the present disclosure is not limited thereto, and the screw part 16 or the hole part 24 may be, for example, a polygonal, as long as the screw part 16 and the hole part 24 as seen from the top surface are engaged at least at three points.

As described above, according to the key assembly 100 of the present embodiment, since the hole part 24 is arranged at the bottom of the opening part 22, the effect of the capstan screw 9 subjected in the rotational directions of the key 2 due to the environmental changes and aging changes can be suppressed. The opening part 22 is arranged so as to surround the capstan screw 9, whereby the strength of the key 2 can be maintained. Therefore, the key assembly 100 can suppress the deviation of the adjustment and maintain reliability.

Second Embodiment

In the second embodiment, a key assembly 100*a* having a configuration differing from that of the key assembly 100 in the first embodiment will be described. A key 2*a* of the second embodiment is different from the key 2 of the first embodiment in that the diameter D1*a* of the opening part 22*a* is almost the same as the maximum diameter d2*a* of the screw part 16*a*. The capstan screw 9*a* of the second embodiment is the same as the capstan screw 9 of the first embodiment. In the key assembly 100*a* of the second embodiment, the opening part 22*a* of the key 2*a* and the screw part 16*a* of the capstan screw 9*a* partially contact each other. The same parts as those in the first embodiment are given the same numbers as those of the previous description, and repeated descriptions will be omitted.

[Configuration of a Fastening Points of a Capstan Screw and a Key]

Figure 6:
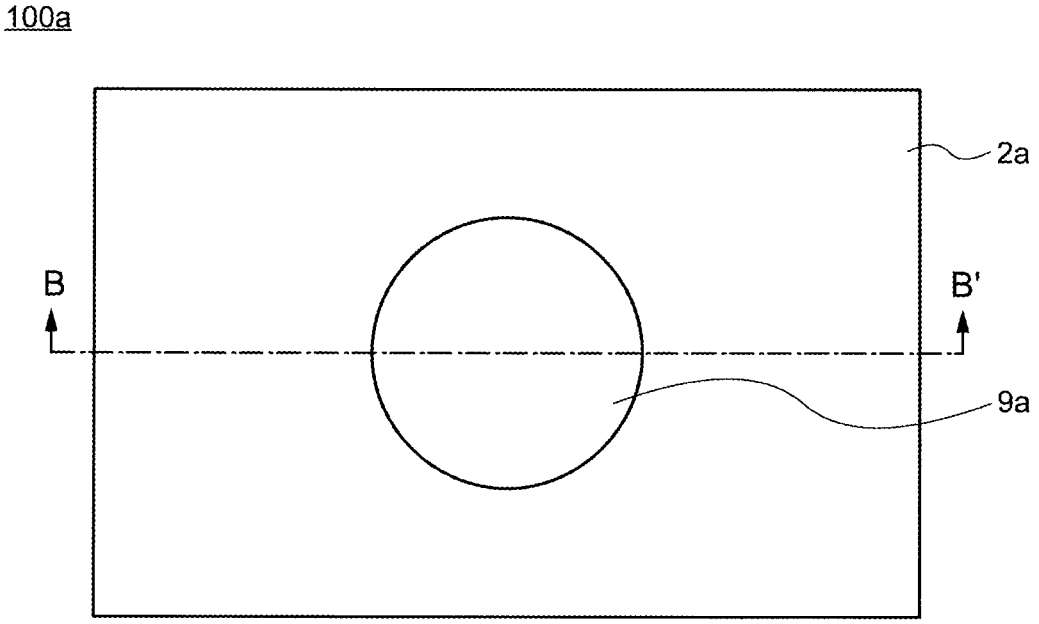
FIG. 6 is a partial enlargement top view showing a fastening point of a capstan screw and a key in one embodiment of the present disclosure.
Figure 7:
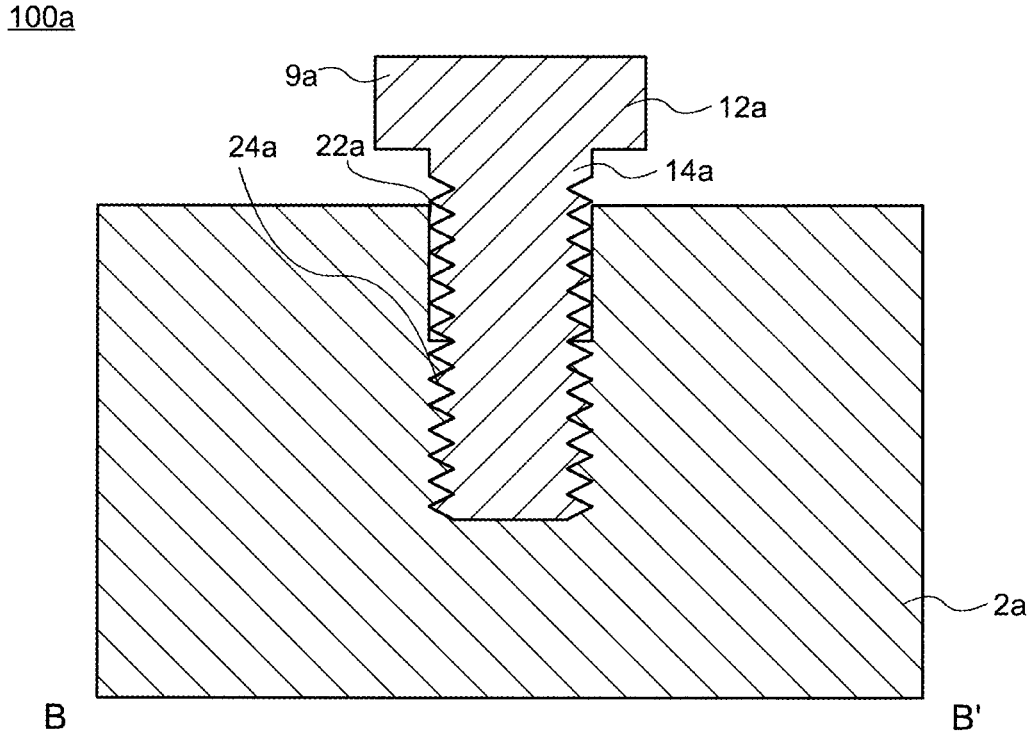
FIG. 7 is a partial enlargement cross-sectional view showing a fastening point of a capstan screw and a key in one embodiment of the present disclosure.
Figure 8:
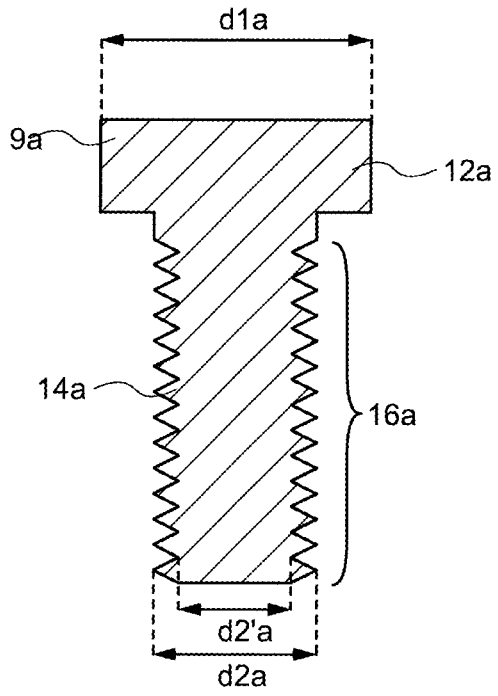
FIG. 8 is a partial enlargement cross-sectional view showing the capstan screw prior to fastening in one embodiment of the present disclosure.
Figure 9:
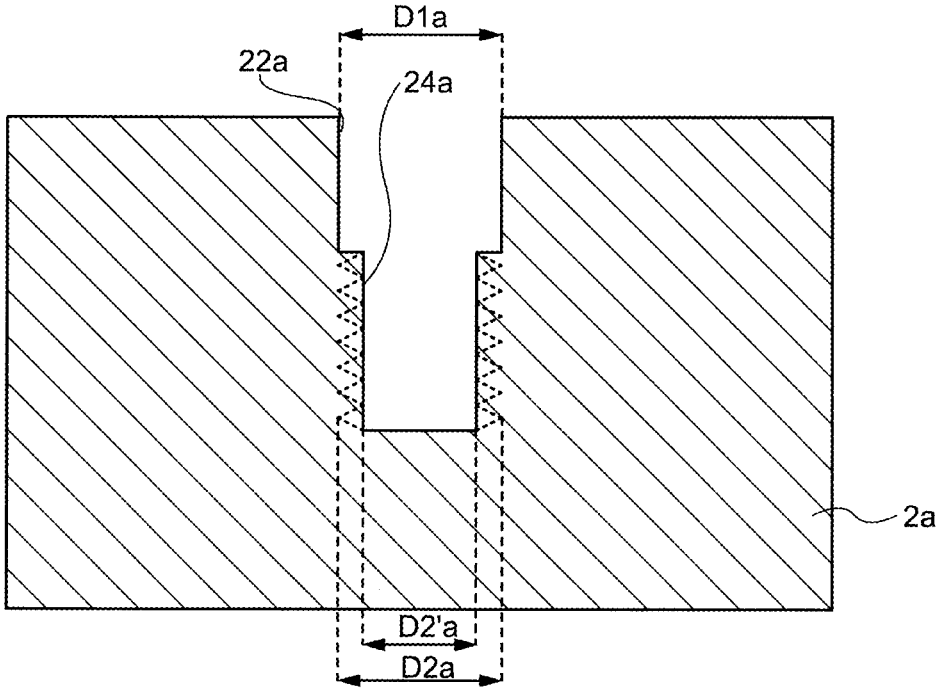
FIG. 9 is a partial enlargement cross-sectional view showing the key prior to fastening in one embodiment of the present disclosure.

A configuration of a fastening point of a capstan screw and a key will be described in detail with reference to FIGS. 6 to 9. FIG. 6 is a partial enlarged top view of a fastening point of the capstan screw and the key according to an embodiment of the present disclosure. FIG. 7 is a partial enlargement cross-sectional view of the fastening point of the capstan screw and the key according to an embodiment of the present disclosure. FIG. 8 is a partial enlargement cross-sectional view of the capstan screw prior to fastening in one embodiment. FIG. 9 is a partial enlargement cross-sectional view of the key prior to fastening in one embodiment.

The Key 2 includes an opening part 22*a* and a hole part 24*a* having an inner side surface for supporting the capstan screw 9*a* on the upper surface (the surface to be pressed). Here, the hole part 24*a* is arranged at the bottom of the opening part 22*a*. That is, the opening part 22*a* is arranged on the upper surface side of the key 2*a* than the hole part 24*a*. The opening part 22*a* and the hole part 24*a* are continuous with each other in the directions of rotation of the key assembly 100*a*. The inner side surface of the opening part 22*a* and the inner side surface of the hole part 24*a* are both arranged so as to surround the capstan screw 9*a*. Since the hole part 24*a* for supporting the capstan screw 9*a* is arranged at the bottom of the opening part 22*a*, the effect of the capstan screw 9*a* subjected in the rotational directions of the key 2*a* due to the environmental changes and aging changes can be suppressed. The strength of the key 2*a* can be maintained by arranging the opening part 22*a* so as to surround the capstan screw 9*a*. Therefore, the key assembly 100*a* can suppress the deviation of the adjustment and maintain the reliability.

In this embodiment, the diameter D1*a* of the opening part 22*a* is almost the same as the diameter D2*a* of the hole part 24*a*. The diameter D1*a* of the opening part 22*a* is almost the same as the diameter d2*a* of the screw part 16*a*. For this reason, the inner side surface of the opening part 22*a* is in contacts with the top of the thread of the screw part 16*a*. Since the diameter D1*a* of the opening part 22*a* is almost the same as the diameter D2*a* of the hole part 24*a*, the strength of the key 2*a* can be improved. The capstan screw 9*a* and the key 2*a* can be stably fastened by contacting the inner side surface of the opening part 22*a* and the top of the thread of the screw part 16*a*.

The head part 12*a* of the capstan screw 9*a* is arranged outside of the opening part 22*a*. That is, the head part 12*a* of the capstan screw 9*a* protrudes to the upper surface side (the surface to be pressed) of the key 2*a*. In this embodiment, the diameter d1*a* of the head part 12*a* of the capstan screw 9*a* is larger than the diameter D1*a* of the opening part 22*a*.

The screw part 16*a* of the capstan screw 9*a* engages the inner side surface of the hole part 24*a*. Thus, maximum diameter d2*a* of the screw part 16*a* and maximum diameter D2*a* of the hole part 24*a* are almost the same, and minimum diameter d2'*a* of the screw part 16*a* and minimum diameter D2'*a* of the hole part 24*a* are almost the same. As shown in FIG. 9, the hole part 24*a* prior to fastening the capstan screw 9*a* is a prepared hole which has not been internally threaded. Therefore, the maximum diameter of the hole part 24*a* prior to fastening the capstan screw 9*a* and minimum diameter d2'*a* of the screw part 16*a* is almost the same. The maximum diameter D2'*a* of the hole part 24*a* prior to fastening the capstan screw 9*a* is smaller than the maximum diameter D1*a* of the opening part 22*a*. As shown by the dotted line in FIG. 9, the hole part 24*a* is internally threaded by fastening the capstan screw 9*a*, and the maximum diameter D2*a* of the hole portion 24*a* is almost the same as the maximum diameter d2*a* of the screw portion 16*a*. The diameter D2*a* of the hole part 24*a* is almost the same as the diameter D1*a* of the opening part 22*a*.

As described above, according to the key assembly 100*a* of the present embodiment, since the hole part 24*a* is arranged at the bottom of the opening part 22*a*, the effect of the capstan screw 9*a* subjected in the rotational directions of the key 2*a* due to the environmental change and the aging change can be suppressed. The opening part 22*a* is arranged so as to be in contact with the capstan screw 9*a*, whereby the capstan screw 9*a* and the key 2*a* can be stably fastened while the strength of the key 2*a* is improved. Therefore, the key assembly 100*a* can suppress the deviation of the adjustment and improve reliability.

Third Embodiment

The capstan screw 9*b* of the third embodiment is different from the capstan screw 9*a* of the second embodiment in that the shaft part 14*b* has a screw part 16*b* and a cylinder part 18*b*. The key 2*b* of the third embodiment is the same as the key 2*a* of the second embodiment. In the key assembly 100*b* of the third embodiment, the opening part 22*b* of the key 2*b* and the cylinder part 18*b* of the capstan screw 9*b* are in contact with each other. The same parts as those of the first embodiment and the second embodiment are given the same numerals as those of the previous description, and repeated descriptions will be omitted.

[Configuration of a Fastening Points of a Capstan Screw and a Key]

Figure 10:
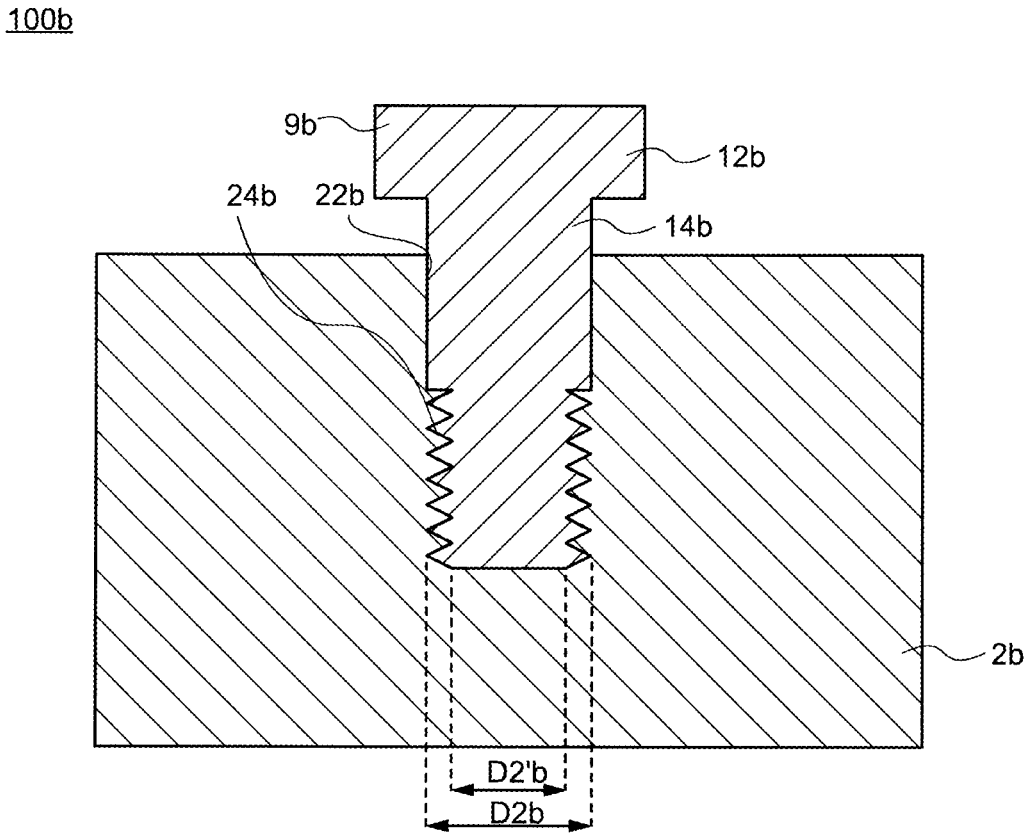
FIG. 10 is a partial enlargement cross-sectional view showing a fastening point of a capstan screw and a key in one embodiment of the present disclosure.
Figure 11:
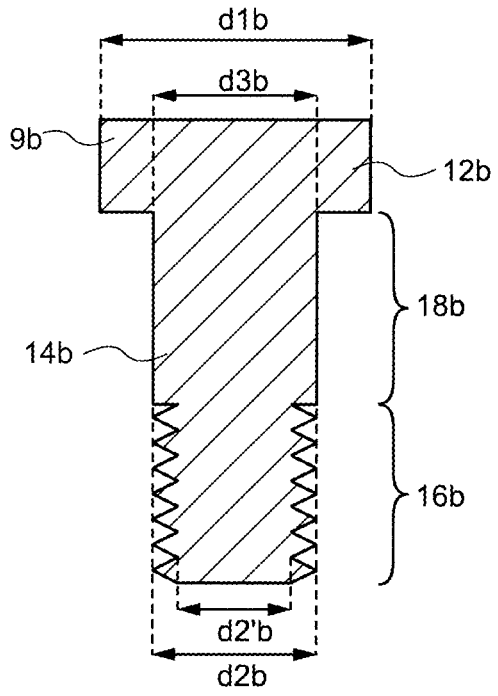
FIG. 11 is a partial enlargement cross-sectional view showing the capstan screw prior to fastening in one embodiment of the present disclosure.

A configuration of a fastening point of a capstan screw and a key will be described in detail with reference to FIGS. 10 and 11. FIG. 10 is a partial enlargement cross-sectional view of the fastening point of the capstan screw and the key according to an embodiment of the present disclosure. FIG. 11 is a partial enlargement cross-sectional view of the capstan screw prior to fastening in one embodiment. Here, a partial enlarged top view of the fastening point of the capstan screw and the key and a partial enlarged cross-sectional view of the key prior to fastening are the same as those in the second embodiment, and therefore will not be described.

The capstan screw 9*b* has a head part 12*b* and a shaft part 14*b*. In this embodiment, the shaft part 14*b* has a screw part

16*b* and a cylinder part 18*b*. The screw part 16*b* of the capstan screw 9*b* is fastened to the hole part 24*b* of the key 2*b*. In FIG. 10, the screw part 16*b* are all located in the hole part 24*b*. However, the present disclosure is not limited thereto, and a part of the screw part 16*b* may be arranged in the opening part 22*b*. In this instance, a part of the hole part 24*b* may have a space in which the screw part 16*b* is not arranged. The diameter d3*b* of the cylinder part 18*b* and the diameter d2*b* of the screw part 16*b* are almost the same. Here, the diameter d3*b* of the cylinder part 18*b* shows the maximum diameter of the cylinder part 18*b* as seen in the axial direction, the diameter d2*b* of the screw part 16*b* shows the maximum diameter of the screw part 16*b* as seen in the axial direction. In this embodiment, the cylinder part 18*b* and the shaft part 14*b* as seen from the top surface is circular. The center of the cylinder part 18*b* is almost coincident with the center of the shaft part 14*b* as seen from the top surface. However, the present disclosure is not limited thereto, and the cylinder part 18*b* may have a polygonal shape, for example.

The key 2*b* includes an opening part 22*b* and a hole part 24*b* having an inner side surface for supporting the capstan screw 9*b* on its upper surface (the surface to be pressed). Here, the hole part 24*b* is arranged at the bottom of the opening part 22*b*. That is, the opening part 22*b* is arranged at the upper surface side of the key 2*b* than the hole part 24*b*. The opening part 22*b* and the hole part 24*b* are continuous in the direction of rotation of the key assembly 100*b*. The inner side surface of the opening part 22*b* and the inner side surface of the hole part 24*b* are both arranged to surround the capstan screw 9*b*. Since the hole part 24*b* for supporting the capstan screw 9*b* is arranged at the bottom of the opening part 22*b*, the effect of the capstan screw 9*b* subject in the rotational directions of the key 2*b* due to the environmental changes and aging changes can be suppressed. The strength of the key 2*b* can be maintained by arranging the opening part 22*b* so as to surround the capstan screw 9*b*. Therefore, the key assembly 100*b* can suppress the deviation of the adjustment and maintain the reliability.

In this embodiment, the diameter D1*b* of the opening part 22*b* is almost the same as the diameter D2*b* of the hole part 24*b*. The diameter D1*b* of the opening part 22*b* is almost the same as the diameter d3*b* of the cylinder part 18*b*. Therefore, the inner side surface of the opening part 22*b* is contact with the outer surface of the cylinder part 18*b*. Since the diameter D1*b* of the opening part 22 *b* is almost the same as the diameter D2*b* of the hole part 24*b*, the strength of the key 2*b* can be improved. The capstan screw 9*b* and the key 2*b* can be stably fastened by contacting the inner side surface of the opening part 22*b* and the outer surface of the cylinder part 18*b*.

As described above, according to the key assembly 100*b* of the present embodiment, since the hole part 24*b* is arranged at the bottom of the opening part 22*b*, the effect of the capstan screw 9*b* subjected in the rotational directions of the key 2*b* due to the environmental changes and the aging changes can be suppressed. The opening part 22*b* is arranged so as to be in contact with the capstan screw 9*b*, whereby the capstan screw 9*b* and the key 2*b* can be stably fastened while the strength of the key 2*b* is improved. For this reason, the key assembly 100*b* can suppress deviation of the adjustment and further improve the reliability.

Fourth Embodiment

The capstan screw 9*c* of the fourth embodiment is different from the capstan screw 9*b* of the third embodiment in that the diameter d3*c* of the cylinder part 18*c* is smaller than the diameter d2*c* of the screw part 16*c*. The key 2*c* of the fourth embodiment is the same as the key 2*b* of the third embodiment. The same parts as those of the first to third embodiments are given the same numerals as those of the previous description, and repeated descriptions will be omitted.

[Configuration of a Fastening Points of a Capstan Screw and a Key]

Figure 12:
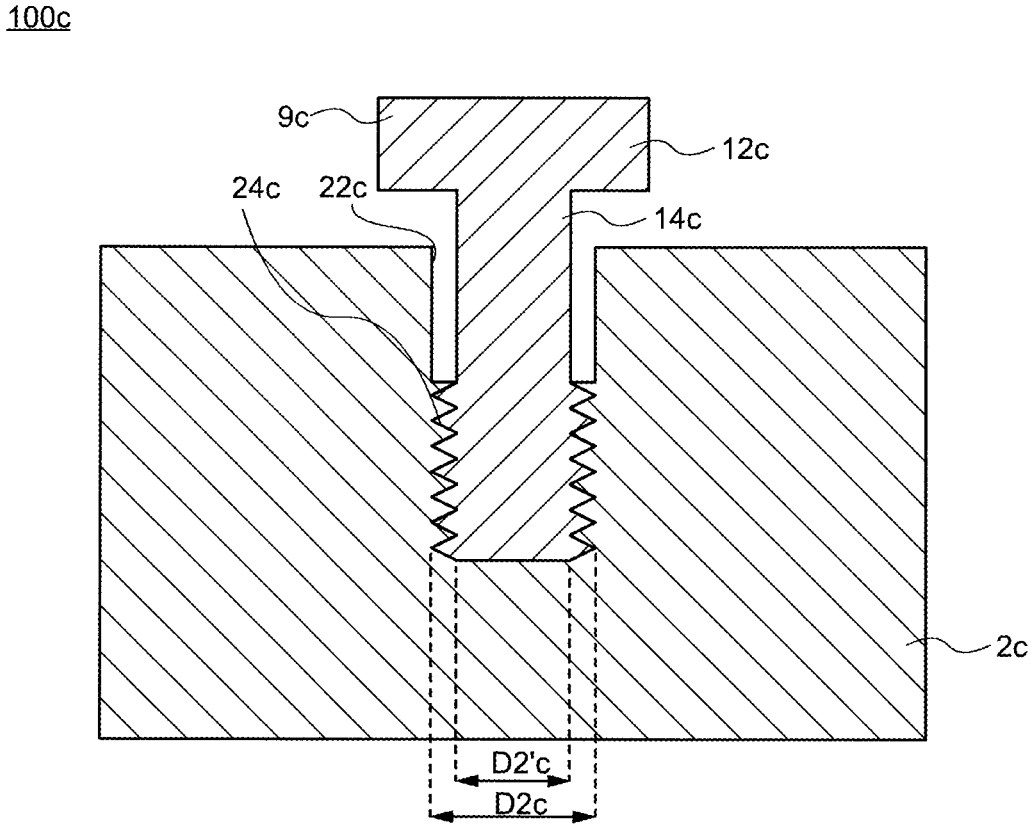
FIG. 12 is a partial enlargement cross-sectional view showing a fastening point of a capstan screw and a key in one embodiment of the present disclosure.
Figure 13:
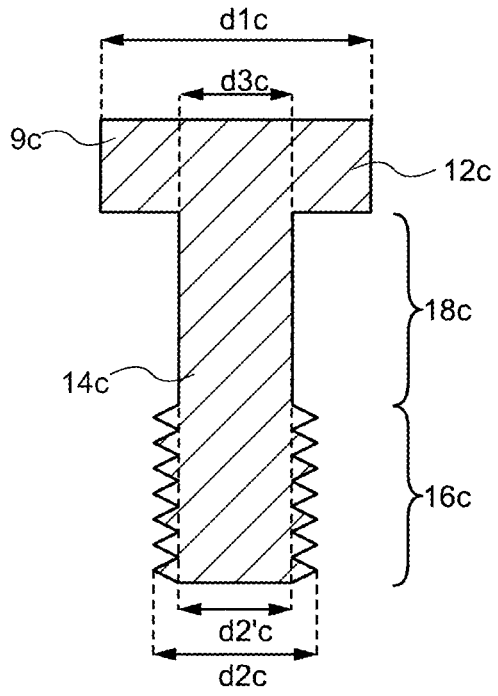
FIG. 13 is a partial enlargement cross-sectional view showing the capstan screw prior to fastening in one embodiment of the present disclosure.

A configuration of a fastening point of a capstan screw and a key will be described in detail with reference to FIGS. 12 and 13. FIG. 12 is a partial enlargement cross-sectional view of the fastening point of the capstan screw and the key according to an embodiment of the present disclosure. FIG. 13 is a partial enlargement cross-sectional view of the capstan screw prior to fastening in one embodiment. Here, a partial enlarged top view of the fastening point of the capstan screw and the key and a partial enlarged cross-sectional view of the key prior to fastening are the same as those in the second embodiment, and therefore will not be described.

The capstan screw 9*c* has a head part 12*c* and a shaft part 14*c*. In this embodiment, the shaft part 14*c* has a screw part 16*c* and a cylinder part 18*c*. The screw part 16*c* of the capstan screw 9*c* is fastened to the hole part 24*c* of the key 2*c*. In FIG. 12, the screw part 16*c* are all placed in the hole part 24*c*. However, the present disclosure is not limited thereto, a part of the screw part 16*c* may be arranged in the opening part 22*c*. In this instance, a part of the hole part 24*c* may have a space in which screw the part 16*c* is not arranged. The diameter d3*c* of the cylinder part 18*c* is smaller than the diameter d2*c* of the screw part 16*c*.

The key 2*c* includes an opening part 22*c* and a hole part 24*c* having an inner side surface for supporting the capstan screw 9*c* on its upper surface (the surface to be pressed). The hole part 24*c* is arranged at the bottom of the opening part 22*c*. That is, the opening part 22*c* is arranged at the upper surface side of the key 2*c* with respect to the hole part 24*c*. The opening part 22*c* and the hole part 24*c* are continuous in the direction of rotation of the key assembly 100*c*. The inner side surface of the opening part 22*c* and the inner side surface of the hole part 24*c* are both arranged to surround the capstan screw 9*c*. Since the hole part 24*c* for supporting the capstan screw 9*c* is arranged at the bottom of the opening part 22*c*, the effect of the capstan screw 9*c* subject in the rotational directions of the key 2*c* due to the environmental changes and aging changes can be suppressed. The strength of the key 2*c* can be maintained by arranging the opening part 22*c* so as to surround the capstan screw 9*c*. Therefore, the key assembly 100*c* can suppress the deviation of the adjustment and maintain the reliability.

In this embodiment, the diameter D1*c* of the opening part 22*c* is almost the same as the diameter D2*c* of the hole part 24*c*. Since the diameter D1*c* of the opening part 22*c* is almost the same as the diameter D2*c* of the hole part 24*c*, the strength of the key 2*c* can be improved. The cylinder part 18*c* of the capstan screw 9*c* is separated from the inner side surface of the opening part 22*c*. The diameter D1*c* of the opening part 22*c* is larger than the maximum diameter d3*c* of the cylinder part 18*c*.

As described above, according to the key assembly 100*c* of the present embodiment, since the hole part 24*c* is arranged at the bottom of the opening part 22*c*, the effect of the capstan screw 9*c* subjected in the rotational directions of the key 2*c* due to the environmental change and the aging change can be suppressed. The strength of the key 2*c* can be maintained by arranging the opening part 22*c* so as to surround the capstan screw 9*c*. Therefore, the key assembly 100*c* can suppress the deviation of the adjustment and improve reliability.

Fifth Embodiment

The key 2*d* of the fifth embodiment is different from the key 2*c* of the fourth embodiment in the configuration of the opening part 22*d*. The capstan screw 9*d* of the fifth embodiment is the same as the capstan screw 9*c* of the fourth embodiment. In the key assembly 100*d* of the fifth embodiment, the opening part 22*d* of the key 2*d* and the cylinder part 18*d* of the capstan screw 9*d* partially contact each other. The same parts as those of the first to fourth embodiments are given the same numerals as those of the previous description, and repeated descriptions will be omitted.

[Configuration of a Fastening Points of a Capstan Screw and a Key]

Figure 14:
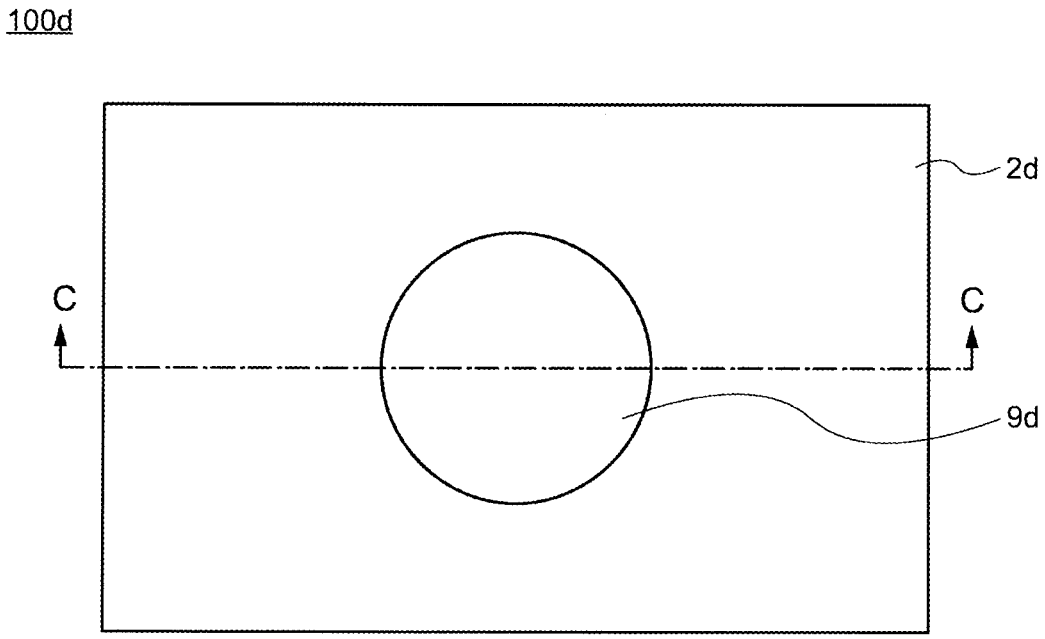
FIG. 14 is a partial enlargement top view showing a fastening point of a capstan screw and a key in one embodiment of the present disclosure.
Figure 15:
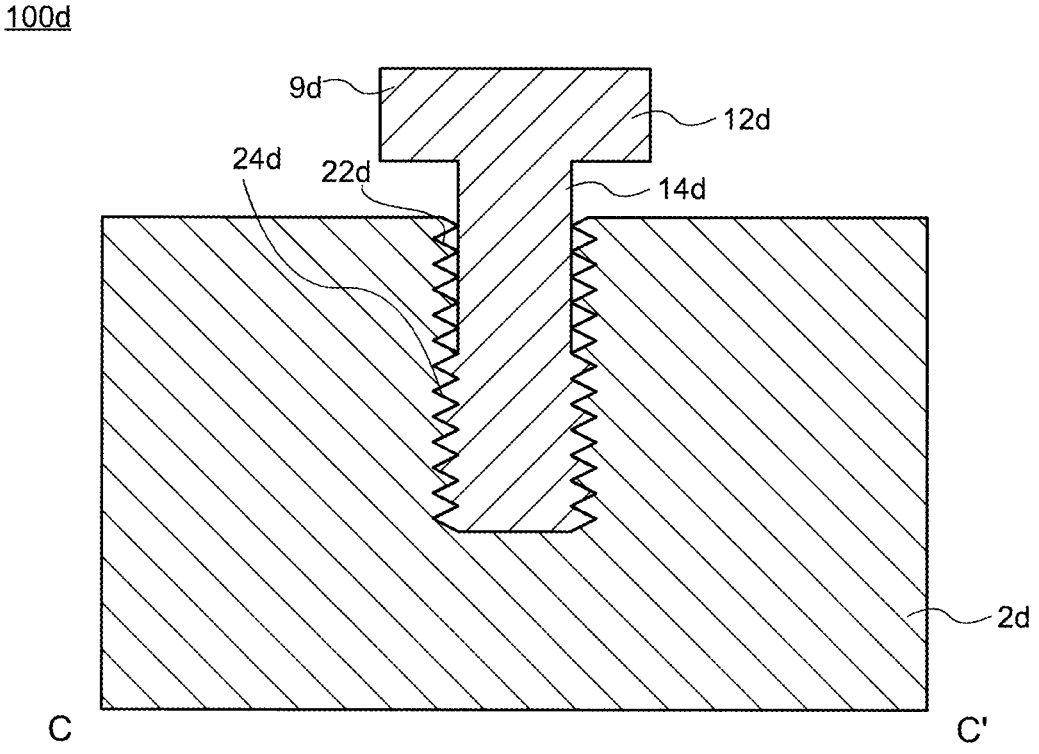
FIG. 15 is a partial enlargement cross-sectional view showing a fastening point of a capstan screw and a key in one embodiment of the present disclosure.
Figure 16:
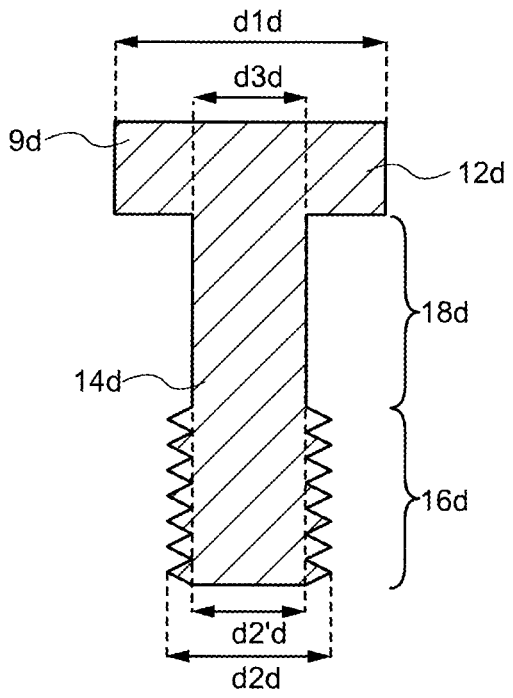
FIG. 16 is a partial enlargement cross-sectional view showing the capstan screw prior to fastening in one embodiment of the present disclosure.
Figure 17:
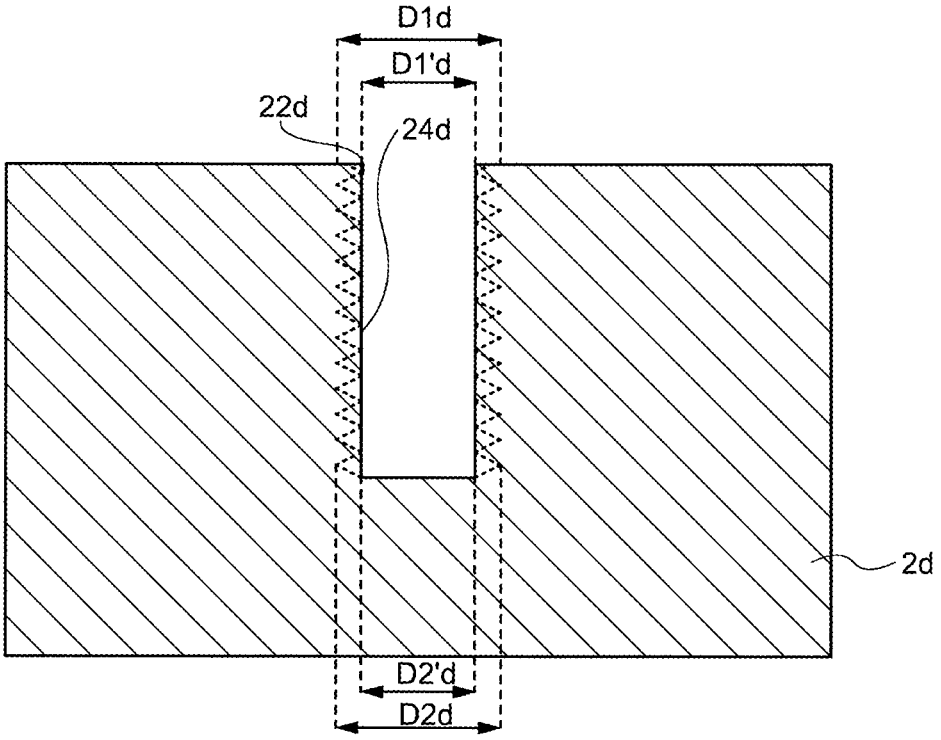
FIG. 17 is a partial enlargement cross-sectional view showing the key prior to fastening in one embodiment of the present disclosure.

A configuration of a fastening point of a capstan screw and a key will be described in detail with reference to FIGS. 14 to 17. FIG. 14 is a partial enlargement top view of a fastening point of the capstan screw and the key according to an embodiment of the present disclosure. FIG. 15 is a partial enlarged cross-sectional view of a fastening point of the capstan screw and the key according to an embodiment of the present disclosure. FIG. 16 is a partial enlargement cross-sectional view of the capstan screw prior to fastening in one embodiment. FIG. 17 is a partial enlargement cross-sectional view of the key prior to fastening in one embodiment.

The key 2*d* includes an opening part 22*d* and a hole part 24*d* having an inner side surface for supporting the capstan screw 9*d* on its upper surface (the surface to be pressed). The hole part 24*d* is arranged at the bottom of the opening part 22*d*. That is, opening part 22*d* is arranged at the upper surface side of the key 2*d* with respect to the hole part 24*d*. The opening part 22*d* and the hole part 24*d* are continuous in the direction of rotation of the key assembly 100*d*. The inner side surface of the opening part 22*d* and inner side surface of hole part 24*d* are both arranged to surround the capstan screw 9*d*. Since the hole part 24*d* on which the capstan screw 9*d* is supported is arranged at the bottom of the opening part 22*d*, the effect of the capstan screw 9*d* subject in the rotational directions of the key 2*d* due to the environmental changes and aging changes can be suppressed. The strength of the key 2*d* can be maintained by arranging the opening part 22*d* so as to surround the capstan screw 9*d*. Therefore, the key assembly 100*d* can suppress the deviation of the adjustment and maintain reliability.

In this embodiment, the shape of the opening part 22*d* is almost the same as the shape of the hole part 24*d*, and thread is cut. The maximum diameter D1*d* of the opening part 22*d* is almost the same to the maximum diameter D2*d* of the hole part 24*d*. The minimum diameter D1'*d* of the opening part 22*d* is almost same to the minimum diameter D2'*d* of the hole part 24*d*. Furthermore, the maximum diameter D1*d* of the opening part 22*d* and the maximum diameter D2*d* of the hole part 24*d* is almost same to the maximum diameter d2*d* of the screw part 16*d*. The minimum diameter D1'*d* of the opening part 22*d* and the minimum diameter D2'*d* of the hole part 24*d* are almost same to the minimum diameter d2'*d* of the screw part 16*d*. The minimum diameter D1'*d* of the opening part 22*d* and the minimum diameter D2'*d* of the hole part 24*d* are almost the same as the maximum diameter d3*d* of the cylinder part 18*d*. For this reason, the top of the thread of the opening part 22*d* (female thread having the minimum diameter D1'*d*) is in contacts with the outer surface of the cylinder part 18*d*. Since the maximum diameter D1*d* of the opening part 22*d* is almost the same as the maximum diameter D2*d* of the hole part 24*d*, the strength of the key 2*d* can be improved. The capstan screw 9*d* and the key 2*d* can be stably fastened by contacting the top of the threads of the opening part 22*d* and the outer surface of the cylinder part 18*d*.

The screw part 16*d* of the capstan screw 9*d* engages the inner side surface of the hole part 24*d*. As shown in FIG. 17, the opening part 22*d* and the hole part 24*d* prior to fastening the capstan screw 9*d* are prepared holes which has not been internally threaded. Therefore, the maximum diameter of the opening part 22*d* prior to fastening the capstan screw 9*d* and the maximum diameter D2'*d* of the hole part 24*d* are almost same to the minimum diameter d2'*d* of the screw part 16*d*. As shown by the dotted line in FIG. 17, the opening part 22*d* and the hole part 24*d* are internally threaded by fastening the capstan screw 9*d*, and the maximum diameter D1*d* of the opening part 22*d*, the maximum diameter D2*d* of the hole part 24*d*, and the maximum diameter d2*d* of the screw part 16*d* are almost the same.

As described above, according to the key assembly 100*d* of the present embodiment, since the hole part 24*d* is arranged at the bottom of the opening part 22*d*, the effect of the capstan screw 9*d* subjected in the rotation directions of the key 2*d* due to the environmental changes and aging changes can be suppressed. The capstan screw 9*d* and the key 2*d* can be stably fastened while improving the strength of the key 2*d* by arranging the opening part 22*d* so as to be in contact with the capstan screw 9*d*. Therefore, the key assembly 100*d* can suppress the deviation of the adjustment and further improve the reliability.

Sixth Embodiment

The capstan screw 9*e* of the sixth embodiment is different from the capstan screw 9*d* of the fifth embodiment in that the diameter d3*e* of the cylinder part 18*e* is even smaller than the minimum diameter d2'*e* of the screw part 16*e*. The key 2*e* of the sixth embodiment is the same as the key 2*d* of the fifth embodiment. The parts that are the same as those in the first to fifth embodiments are given the same numerals as those of the previous description, and repeated descriptions will be omitted.

[Configuration of a Fastening Points of a Capstan Screw and a Key]

Figure 18:
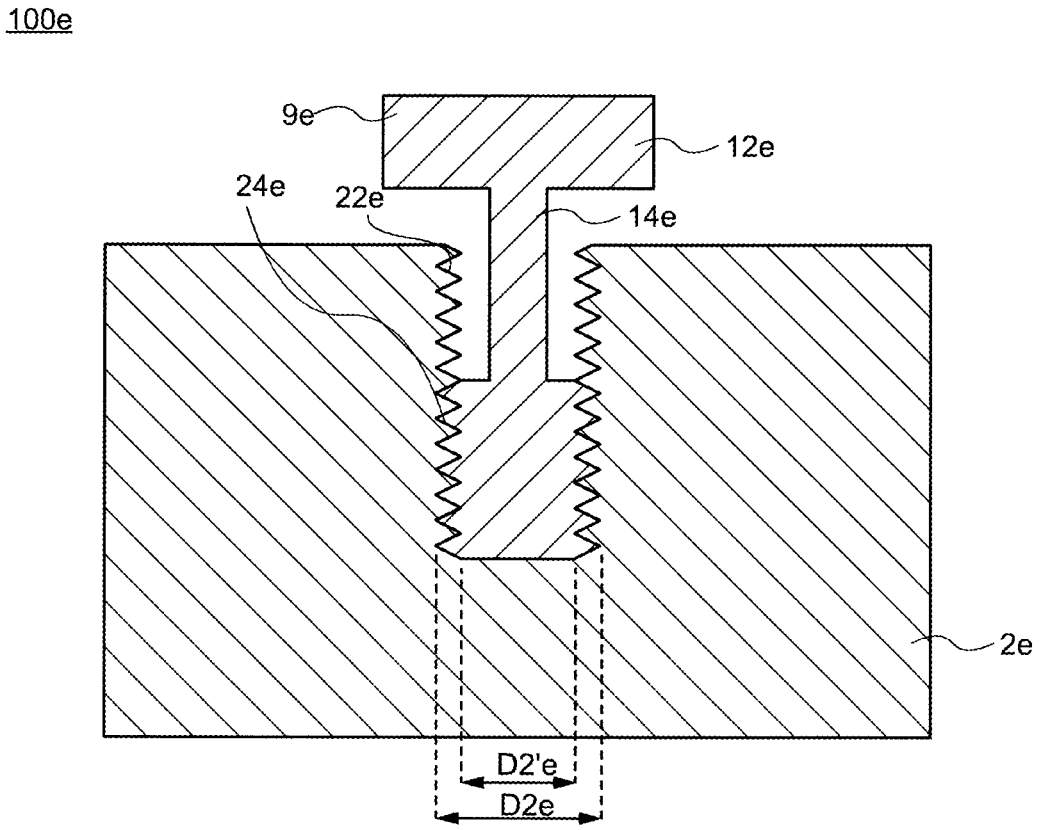
FIG. 18 is a partial enlargement cross-sectional view showing a fastening point of a capstan screw and a key in one embodiment of the present disclosure.
Figure 19:
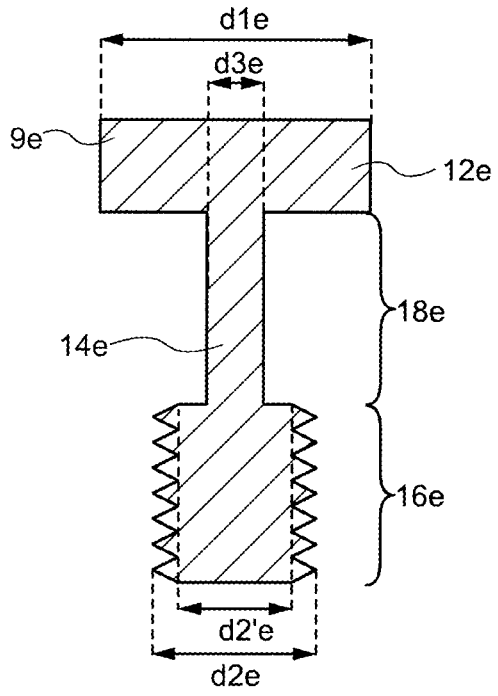
FIG. 19 is a partial enlargement cross-sectional view showing the capstan screw prior to fastening in one embodiment of the present disclosure.

A configuration of a fastening point of a capstan screw and a key will be described in detail with reference to FIGS. 18 and 19. FIG. 18 is a partial enlarged cross-sectional view of a fastening point of the capstan screw and the key according to an embodiment of the present disclosure. FIG. 19 is a partial enlargement cross-sectional view of the capstan screw prior to fastening in one embodiment. Here, a partial enlarged top view of the fastening point of the capstan screw and the key and a partial enlarged cross-sectional view of a key prior to fastening are the same as those in the fifth embodiment, and therefore will not be described.

The capstan screw 9*e* has a head part 12*e* and a shaft part 14*e*. In this embodiment, the shaft part 14*e* has a screw part 16*e* and a cylinder part 18*e*. The screw part 16*e* of the capstan screw 9*e* is fastened to the hole part 24*e* of the key 2*e*. In FIG. 18, the screw part 16*e* are all placed in the hole part 24*e*. However, the present disclosure is not limited thereto, and a part of the screw part 16*e* may be arranged in the opening part 22*e*. In this instance, a part of the hole part 24*e* may have a space in which screw part 16*e* is not arranged. The diameter d3*e* of the cylinder part 18*e* is smaller than the maximum diameter d2*e* of the screw part 16*e* and the minimum diameter d2'*e* of the screw part 16*e*.

The key 2*e* includes an opening part 22*e* and a hole part 24*e* having an inner side surface for supporting the capstan screw 9*e* on its upper surface (the surface to be pressed). Here, the hole part 24*e* is arranged at the bottom of the opening part 22*e*. That is, the opening part 22*e* is arranged at the upper surface side of the key 2*e* with respect to the hole part 24*e*. The opening part 22*e* and the hole part 24*e* are continuous in the direction of rotation of the key assembly 100*e*. The inner side surface of the opening part 22*e* and the inner side surface of the hole part 24*e* are both arranged to surround the capstan screw 9*e*. Since the hole part 24*e* for supporting the capstan screw 9*e* is arranged at the bottom of the opening part 22*e*, the effect of the capstan screw 9*e* subject in the rotational directions of the key 2*e* due to the environmental changes and aging changes can be suppressed. The strength of the key 2*e* can be maintained by arranging the opening part 22*e* so as to surround the capstan screw 9*e*. Therefore, the key assembly 100*e* can suppress the deviation of the adjustment and maintain reliability.

In this embodiment, the diameter D1*e* of the opening part 22*e* is almost the same as the diameter D2*e* of the hole part 24*e*. Since the diameter D1*e* of the opening part 22*e* is almost the same as the diameter D2*e* of the hole part 24*e*, the strength of the key 2*e* can be improved. The cylinder part 18*e* of the capstan screw 9*e* is separated from the inner side surface of the opening part 22*e*. The diameter D1*e* of the opening part 22*e* is larger than the maximum diameter d3*e* of the cylinder part 18*e*.

As described above, according to the key assembly 100*e* of the present embodiment, by having the hole part 24*e* at the bottom of the opening part 22*e*, the effect of the capstan screw 9*e* subjected in the rotational directions of the key 2*e* due to the environmental changes and the aging changes can be suppressed. The strength of the key 2*e* can be maintained by arranging the opening part 22*e* so as to surround the capstan screw 9*e*. Therefore, the key assembly 100*e* can suppress the deviation of the adjustment and improve reliability.

Modified Example 1

In the first to sixth embodiments, the screw part is arranged in the hole part. The hole part 24*f* according to the present modified example includes a space in which the screw part 16*f* is not arranged. The key 2*f* of the present modified example is different from the key 2*c* of the fourth embodiment in that the hole part 24*f* is long. The capstan screw 9*f* of the present modified example is the same as the capstan screw 9*c* of the fourth embodiment. The parts that are the same as those of the first to sixth embodiments are given the same numerals as those of the previous description, and repeated descriptions will be omitted.

[Configuration of a Fastening Points of a Capstan Screw and a Key]

Figure 20:
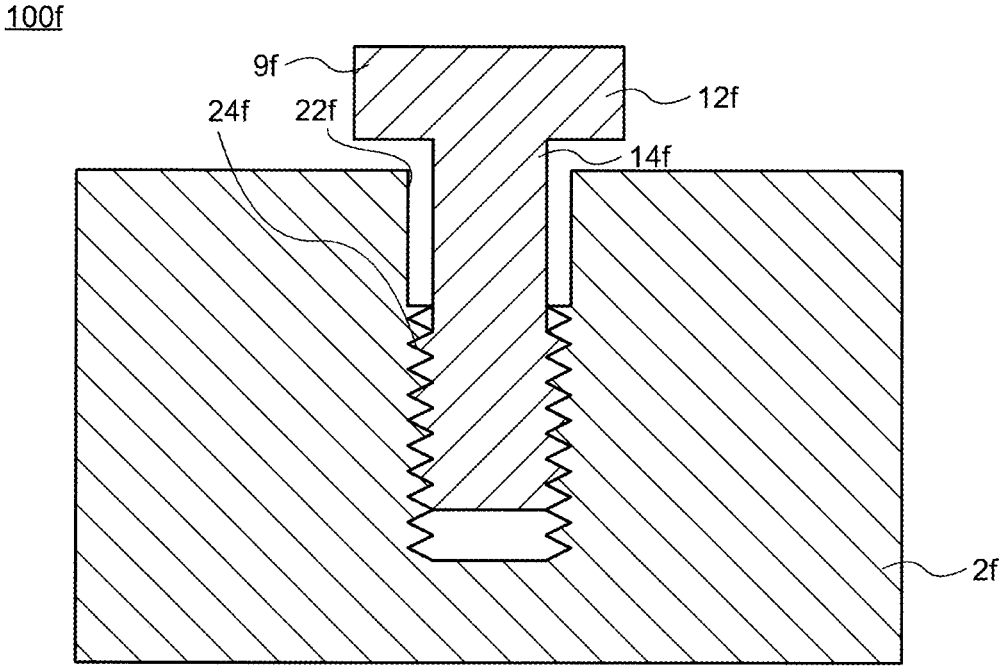
FIG. 20 is a partially enlarged cross-sectional view showing a fastening point of a capstan screw and a key in a modified example of the present disclosure.
Figure 21:
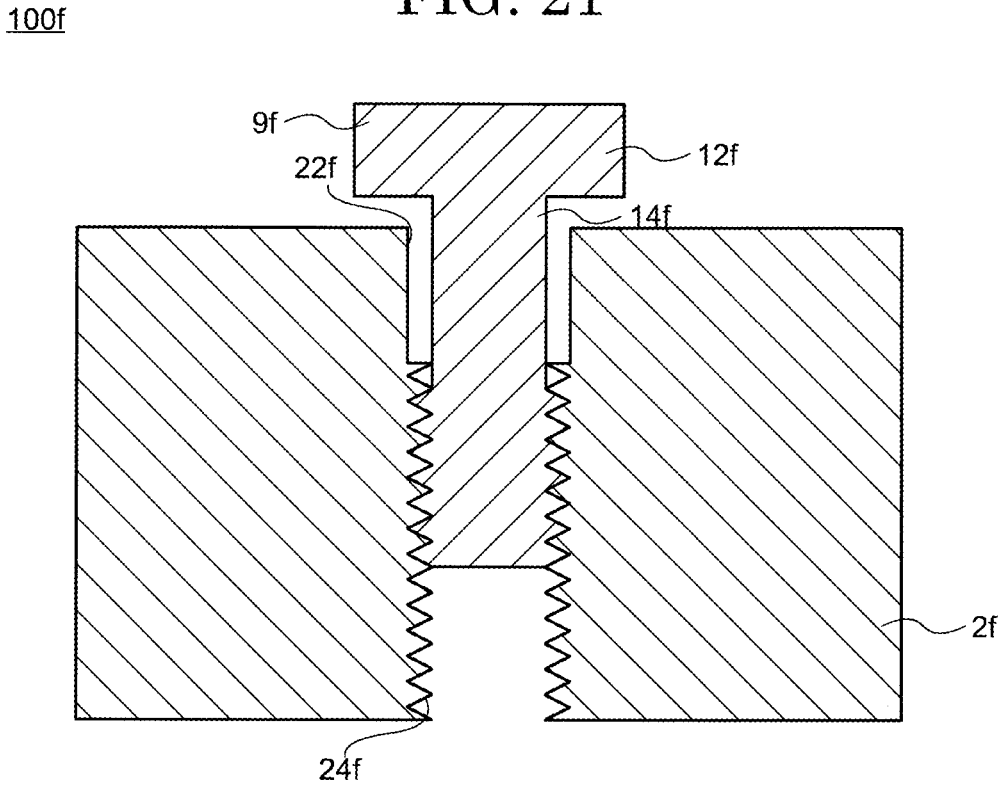
FIG. 21 is a partially enlarged cross-sectional view showing a fastening point of a capstan screw and a key in a modified example of the present disclosure.
Figure 22:
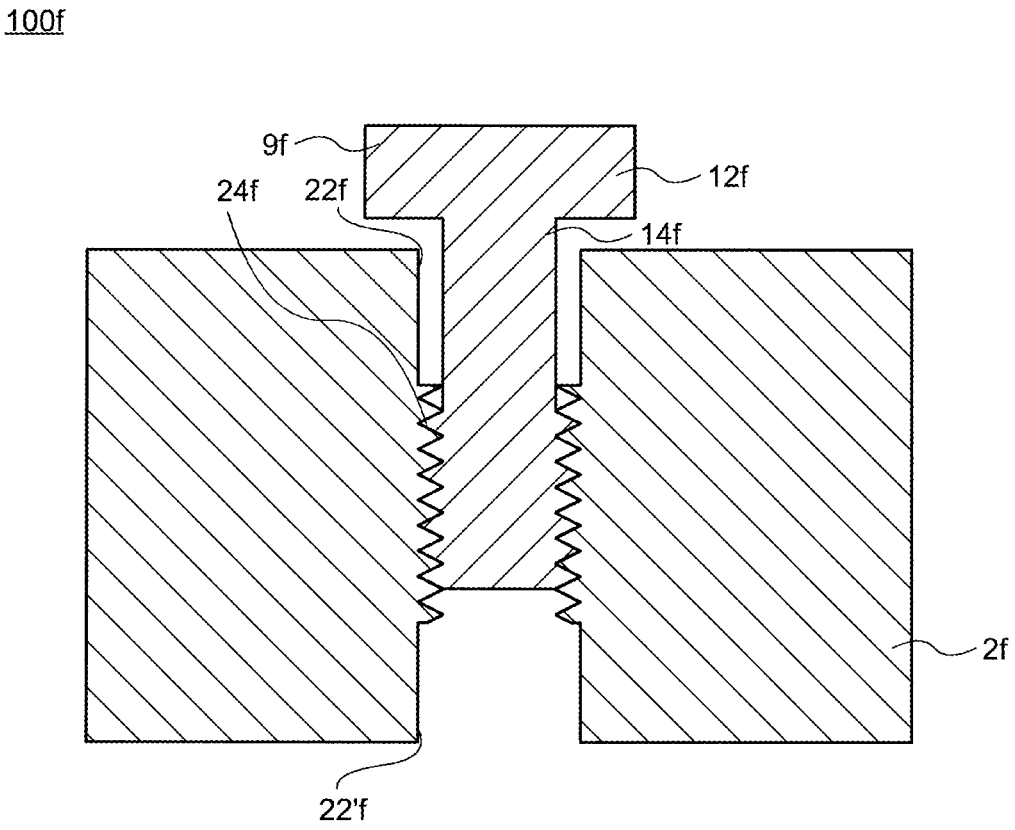
FIG. 22 is a partial enlargement cross-sectional view showing a fastening point of a capstan screw and a key in a modified example of the present disclosure.

A configuration of a fastening point of a capstan screw and a key will be described in detail with reference to FIGS. 20 to 22. FIGS. 20 to 22 are partial enlargements cross-sectional view of the fastening point of the capstan screw and the key in an embodiment of the present disclosure.

The key 2*f* includes an opening part 22*f* and a hole part 24*f* on its upper surface (the surface to be pressed). Here, the hole part 24*f* is arranged at the bottom of the opening part 22*f*. As shown in FIG. 20, the hole part 24*f* may be longer in the axial direction than the screw part 16*f* of the capstan screw 9*f*. As shown in FIG. 21, the hole part 24*f* may further pass through to the opposite side of the opening part 22*f*. As shown in FIG. 22, the hole part 24*f* may further continue with the second opening part 22'*f* in the side opposite to the opening part 22*f* in the rotation directions of the key assembly 100*f*. In FIGS. 20 to 22, capstan screw 9*f* is the same as the capstan screw 9*c* of the fourth embodiment. However, the present disclosure is not limited to this, and the screw part 16*f* of the capstan screw 9*f* may also be long.

In FIGS. 20-22, the screw part 16*f* is entirely arranged in the hole part 24*f*. In addition, a portion of the cylinder part 18*f* is arranged in the hole part 24*f*. However, the present disclosure is not limited thereto, and a part of the screw part 16*f* may be arranged in the opening part 22*f*.

As described above, according to the key assembly 100*f* of the present modified example, since the hole part 24*f* is longer in the axial direction than the screw part 16*f*, the capstan screw 9*f* can be adjusted in a wider area, and the processability of the key 2*f* can be improved.

Modified Example 2

In the present embodiment, the capstan screw has a screw part, and top of the threads of the screw part and valley of the threads of the hole part, and valley of the threads of the screw part and top of the threads of the hole part are fastened so as to engage with each other. However, embodiments of the present disclosure are not limited thereto, and other fastening methods can be adapted. In this instance, the fastening forces of the inner side surface of the opening part and the capstan screw may be smaller than the fastening forces of the inner side surface of the hole part and the capstan screw.

Modified Example 3

In the present embodiment, the keyboard assembly of the ground piano is shown as an exemplary keyboard apparatus. However, the present embodiment is not limited thereto, and the present embodiment can be applied to a keyboard apparatus having an equivalent of the capstan screw on which an equivalent of the action mechanism is mounted. An example of a keyboard apparatus may be an electronic piano, for example.

The embodiments and modified example s described above as the embodiments of the present disclosure can be appropriately combined and implemented as long as they do not contradict each other. It is also within the scope of the present disclosure to the extent that a person skilled in the art adds, deletes, or changes the designs of components as appropriate based on a key assembly of the embodiment, as long as the gist of the present disclosure is included.

What is claimed is:

1. A key assembly comprising:

a capstan; and a key including:

an upper surface, a hole part having a first inner side surface supporting the capstan, and an opening part arranged between the upper surface and the hole part, the opening part having a second inner side surface surrounding the capstan.

2. The key assembly according to claim 1, wherein at least a part of the second inner side surface of the opening part and the capstan are spaced apart from each other.

3. The key assembly according to claim 1, wherein
the capstan includes a head part and a shaft part, the shaft part including a screw part, and
the screw part engages with the first inner side surface of the hole part.

4. The key assembly according to claim 3, wherein
the shaft part further includes a cylinder part between the head part and the screw part, and
a maximum diameter of the cylinder part is smaller than a maximum diameter of the screw part.

5. The key assembly according to claim 4, wherein
the maximum diameter of the cylinder part is smaller than a minimum diameter of the screw part.

6. The key assembly according to claim 4, wherein
all of the screw part is arranged in the hole part.

7. The key assembly according to claim 4, wherein
a part of the cylinder part is arranged in the hole part.

8. The key assembly according to claim 3, wherein
a maximum diameter of the head part is larger than a maximum diameter of the opening part.

9. The key assembly according to claim 1, wherein
a maximum diameter of the opening part equals a maximum diameter of the hole part.

10. The key assembly according to claim 3, wherein
a length of the hole part in an axial direction is longer than a length of the screw part in the axial direction.

11. The key assembly according to claim 1, wherein
the key further includes a lower surface such that the upper surface of the key and the lower surface of the key are opposite sides of the key across a thickness of the key, and
the hole part passes through to the lower surface of the key.

12. The key assembly according to claim 1, wherein
the key is wooden.

13. A keyboard apparatus comprising:
a key bed;
a key assembly comprising a capstan and a key, the key assembly being rotatably arranged with respect to the key bed; and
an action mechanism coupled to the capstan;
wherein the key includes:
an upper surface,
a hole part having a first inner side surface supporting the capstan, and an opening part arranged between the upper surface and the hole part, the opening part having a second inner side surface surrounding the capstan.

14. The keyboard apparatus according to claim 13, wherein
at least a part of the second inner side surface of the opening part and the capstan are spaced apart from each other.

15. The keyboard apparatus according to claim 13, wherein
the capstan includes a head part and a shaft part, the shaft part including a screw part, and
the screw part engages with the first inner side surface of the hole part.

16. The keyboard apparatus according to claim 15, wherein
the shaft part further includes a cylinder part between the head part and the screw part, and
a maximum diameter of the cylinder part is smaller than a maximum diameter of the screw part.

17. The keyboard apparatus according to claim 16, wherein
the maximum diameter of the cylinder part is smaller than a minimum diameter of the screw part.

18. The keyboard apparatus according to claim 16, wherein
all of the screw part is arranged in the hole part.

19. The keyboard apparatus according to claim 16, wherein
a part of the cylinder part is arranged in the hole part.

20. The keyboard apparatus according to claim 15, wherein
a maximum diameter of the head part is larger than a maximum diameter of the opening part.

* * * * *